US006737952B2

(12) United States Patent
Morin et al.

(10) Patent No.: US 6,737,952 B2
(45) Date of Patent: May 18, 2004

(54) COMBINED PRESSURE RESPONSIVE ELECTRICAL SWITCH AND TEMPERATURE SENSOR DEVICE

(75) Inventors: Daniel Morin, Cumberland, RI (US); Alan G. Amore, Cumberland, RI (US); Bryan J. Dague, Norton, MA (US)

(73) Assignee: Texas Instruments Incorporated, Dallas, TX (US)

( * ) Notice: Subject to any disclaimer, the term of this patent is extended or adjusted under 35 U.S.C. 154(b) by 47 days.

(21) Appl. No.: 10/267,507

(22) Filed: Oct. 9, 2002

(65) Prior Publication Data

US 2003/0102955 A1 Jun. 5, 2003

Related U.S. Application Data

(60) Provisional application No. 60/338,739, filed on Dec. 4, 2001.

(51) Int. Cl.[7] ..... H01H 37/40; H01H 37/32

(52) U.S. Cl. ..... 337/300; 337/2; 337/12; 337/299; 337/306; 337/326; 337/327

(58) Field of Search ..... 337/1, 2, 3, 12, 337/298, 299, 300, 306, 326, 327; 29/622

(56) References Cited

U.S. PATENT DOCUMENTS 3,573,410 A * 4/1971 Budzich et al. ..... 200/83 P
4,208,786 A * 6/1980 Merchant et al. ..... 29/612
4,299,117 A * 11/1981 Andrews et al. ..... 73/35.11
4,306,210 A * 12/1981 Saur ..... 337/2
4,581,509 A * 4/1986 Sanford et al. ..... 200/83 P
4,757,165 A * 7/1988 Marcoux et al. ..... 200/83 P
4,842,419 A * 6/1989 Nietert ..... 374/145
4,887,062 A * 12/1989 Bletz ..... 337/299
4,998,087 A * 3/1991 Boulanger ..... 337/354
5,048,974 A * 9/1991 Dupuy ..... 374/142
5,121,094 A * 6/1992 Ting et al. ..... 337/2
5,822,173 A * 10/1998 Dague et al. ..... 361/283.3
6,313,419 B1 11/2001 Amore

FOREIGN PATENT DOCUMENTS

FR 2618597 A1 * 1/1989 ..... H01H/37/32

* cited by examiner

*Primary Examiner*—Anatoly Vortman
(74) *Attorney, Agent, or Firm*—Rossell E. Baumann; Frederick J. Telecky, Jr.

(57) ABSTRACT

A combined pressure responsive electrical switch and temperature sensor device (10, 10') is shown comprising a base member (12) mounting an electrical switch actuatable by a pressure responsive snap-acting disc (16) attached to a port fitting (22) having an elongated temperature sensing portion (**22*h*, 22*h*') extending from the fitting within a threaded bore of the fitting adapted to be inserted in the bore of a fluid pressure source nipple (2). A thermistor (24) is disposed at the distal end (22*k*, 22*k*') of the temperature sensing portion and is electrically connected to terminals (14**) of the base member.

8 Claims, 3 Drawing Sheets

COMBINED PRESSURE RESPONSIVE ELECTRICAL SWITCH AND TEMPERATURE SENSOR DEVICE

RELATED APPLICATIONS

This application claims priority under 35 USC Section 119(e) (1) of U.S. provisional application No. 60/338,739, filed Dec. 4, 2001.

Benefit is claimed under 35 U.S.C. Section 119(e) (1) of U.S. Provisional Application No. 60/338,739, filed Dec. 4, 2001.

FIELD OF THE INVENTION

This invention relates generally to automotive air conditioning systems and more particularly to electrical switches responsive to fluid pressure of air conditioning refrigerant and to sensors for monitoring the temperature of the fluid.

BACKGROUND OF THE INVENTION

Automotive air conditioning systems include a refrigerant fluid pressure sensor to ensure that there is a minimum system pressure to permit the system to function properly and a temperature sensor used for cycling the compressor. With regard to the pressure sensor, it is conventional to use an electrical switch comprising a pressure responsive snap-acting disc member mounted in a housing with one face of the disc in fluid receiving communication with refrigerant fluid being monitored. The disc, upon snapping from one dished configuration to an opposite dished configuration, opens or closes an electric circuit path to provide an on/off control for the system. An example of one such pressure sensor is shown in U.S. Pat. No. 6,313,419, assigned to the assignee of the present invention, the disclosure of which is incorporated herein by this reference.

With regard to the temperature sensor, a temperature sensing probe is conventionally wedged between heat exchanger fins of the evaporator of the air conditioner in close thermal coupling therewith to provide a temperature input of the refrigerant. Although sensing the temperature of the refrigerant through the heat exchanger works well enough to provide satisfactory comfort conditions, there are several limitations to this approach. One such limitation is the fact that the temperature readings of the sensor varies when the sensing portion of the probe, i.e., the thermistor, is dry or wet, as by condensation. Another limitation is the temperature gradient between the sensor and the refrigerant causing a thermal lag in sensing changes in temperature of the refrigerant fluid. Yet another limitation relates to movement of the sensor over time caused by vibrations and the like.

SUMMARY OF THE INVENTION

An object of the present invention is the provision of a combined fluid pressure responsive switch and temperature sensor. Another object is the provision of a device which not only senses the pressure of the refrigerant but also senses the temperature of the fluid. Yet another object of the invention is the provision of a switch and sensor which is free of the prior art limitations noted above.

Briefly stated, a combined pressure responsive electrical switch and temperature sensor made in accordance with a preferred embodiment of the invention comprises a base member having a recess in which an electrical switch is mounted with a pressure responsive snap-acting disc disposed over the recess, the side of the disc facing away from the recess being exposed to a fluid pressure source in a pressure chamber formed between the base and a port fitting. The disc is adapted to snap from an outwardly convex configuration to an outwardly concave configuration at a selected fluid pressure with the disc moving into electrical engagement with movable contacts of the electrical switch to close a circuit path therebetween. The port fitting has a closed ended bore having a threaded sidewall extending along a longitudinal axis with a passageway formed between the closed end of the bore and the pressure chamber. An elongated temperature sensing portion of the port fitting extends into the threaded bore along the longitudinal axis and is spaced from the side wall and a temperature responsive member such as a thermistor is disposed in the temperature sensing portion. The size of the temperature sensing portion is selected so that it fits within the bore of a fluid pressure source nipple which is received in the threaded bore while still allowing fluid flow between the sidewall of the nipple bore and the temperature sensing portion. In one preferred embodiment, the temperature sensing portion is hollow so that the thermistor is open to the fluid source while in another preferred embodiment the temperature sensing portion is hollow with a closed end with the thermistor disposed adjacent the closed end in close thermal coupling therewith. In yet another embodiment, the temperature sensing portion is generally solid. Leads extend from the thermistor up into the pressure chamber beyond a gasket which defines the outer perimeter of the pressure chamber for engagement with extensions of terminals mounted in the base member. In other preferred embodiments, the thermistor is molded in a plastic finger extending from a housing member and arranged to extend into a fluid source.

The port fitting is received on a threaded nipple with the temperature sensing portion extending into the nipple while allowing fluid to pass therebetween and into the pressure chamber for monitoring fluid pressure as well as sensing temperature of the fluid.

Other objects, features and advantages of the invention will be apparent from the following detailed description taken in conjunction with the accompanying drawings wherein like reference numerals refer to like parts.

BRIEF DESCRIPTION OF THE DRAWINGS

The accompanying drawings, incorporated in and constituting a part of the specification, illustrate preferred embodiments of the invention and, together with the description, serve to explain the objects, advantages and principles of the invention. In the drawings.

DETAILED DESCRIPTION OF THE PREFERRED EMBODIMENTS

Figure 1:
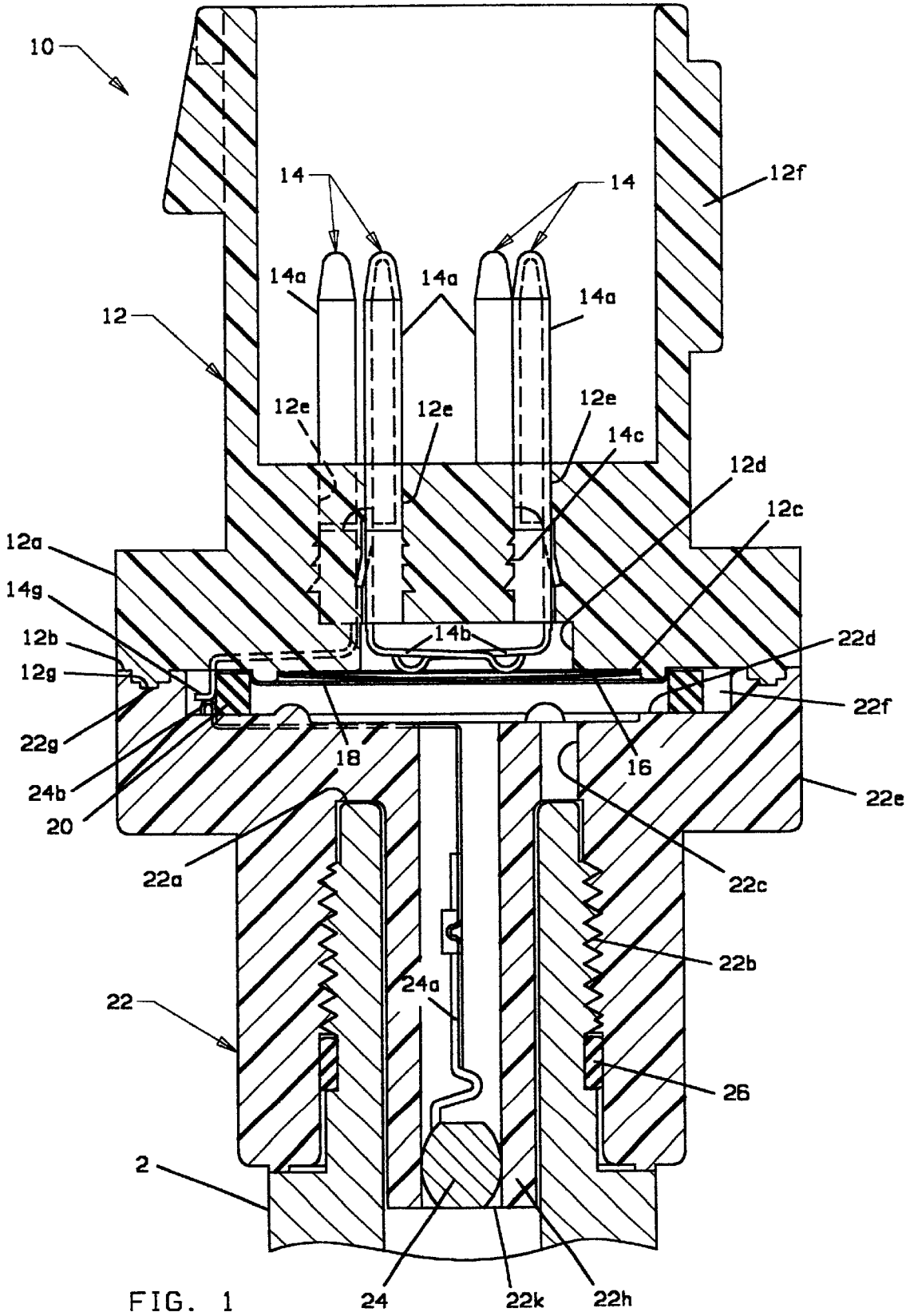
FIG. 1 is a cross sectional view taken through a combined pressure responsive electrical switch and temperature sensor device made in accordance with a preferred embodiment of the invention, the structure shown mounted on a nipple of a fluid pressure source.

With reference to FIG. 1, a combined pressure responsive electrical switch and temperature sensor 10 made in accordance with the invention comprises a base member 12 of suitable electrically insulative, moldable, material having an end wall 12*a*, having an end face 12*b* formed with a generally circular disc seat 12*c*. A recess 12*d* is formed in the end face within the area defined by the disc seat and four spaced apart bores 12*e* (three bores shown in the drawing) are formed through end wall 12*a*.

First and second combination terminal, movable contact arm, and contact members 14, formed of suitable electrically conductive material having good spring characteristics, such as a beryllium copper alloy, are each received in a respective bore 12*e* and extend from a shroud portion 12*f* of the base into recess 12*d*. Each member 14 has a terminal end portion 14*a*, an intermediate portion 14*c* for forming an interference fit in bores 12*e*, and a portion 14*b* swaged to a selected attenuated thickness to provide a flexible arm portion having a suitable spring temper. Flexible arm portions 14*b* are deformed into a generally L-shaped configuration with one leg of the L-shape extending transversely across the end surface of recess 12*d*. Members 14 are oriented so that movable contact arm portions 14*b* extend side by side in spaced apart, opposite directions.

A dished shaped snap-acting disc 16 formed of electrically conductive material, such as stainless steel, and preferably having at least a central portion of the normally downwardly facing concave side coated with a precious metal is received on disc seat 12*c* with a flexible sheet 18 of suitable material such as Kapton preferably with outer Teflon layers, disposed over the disc and extending radially outwardly beyond the disc to be sandwiched between an annular gasket 20 of suitable material and the base member to provide a fluid seal as well as to maintain disc 16 in its seat once port fitting 22, to be discussed, is attached to the base member.

Port fitting 22, formed of suitable material such as a 30% glass fiber reinforced Nylon or the like, has a closed ended bore 22*a* having a threaded wall 22*b*. A passage 22*c* extends from bore 22*a* to a recess 22*d* formed in the end wall 22*e* of the port fitting. Port fitting 22 and base member 12 are suitably attached to one another, as by ultrasonically bonding them together through rib 12*g* of the base member and groove 22*g* of the port fitting. Gasket 20 is located slightly inboard of at least a portion of the outer perimeter of recess 22*d* and is suitably compressed to form a fluid seal of the outer recess portion 22*f* as well as recess 12*d* via flexible layer 18.

An elongated, generally cylindrical temperature sensing portion 22*h* extends away from end wall 22*e* along the longitudinal axis of bore 22*a* and is spaced from the side wall of the bore a distance greater than the wall thickness of a fluid pressure source nipple 2 to permit fluid to flow between temperature sensing portion 22*h* and nipple 2 into a pressure chamber formed by recess 22*d*. In the FIG. 1 embodiment, temperature sensing portion 22*h* is configured as an open ended tube and is provided with a temperature responsive member in the form of a thermistor 24 at the open distal end 22*k*, to be in direct contact with fluid contained in nipple 2. Preferably, a suitable sealing layer of epoxy or the like is placed between thermistor 24 and the inner bore of temperature sensing portion 22*h*. Suitable electrical leads 24*a* extending from thermistor 24 are trained through the temperature sensing portion and extend radially outwardly at the proximal end, preferably insert molded in end wall 22*e*, and project into recess portion 22*f*, outboard of gasket 20, providing a thermistor termination end contact portion 24*b* (only one lead 24*a* and thermistor termination end contact portion 24*b* is shown for ease of illustration). A cooperating terminal termination end contact portion 14*g* of an extension of a terminal 14 extends into recess portion 22*f* from end wall 12*a* of the base member. Each terminal termination end contact portion 14*g* is connected to a respective one of two temperature sensing terminals 14 and is aligned and engageable with a respective thermistor termination end contact portion 24*b*. Nipple 2 is provided with a male thread for reception in the threads of wall 22*b* and a gasket 26 of suitable material is preferably disposed between nipple 2 and port fitting 22.

Figure 2:
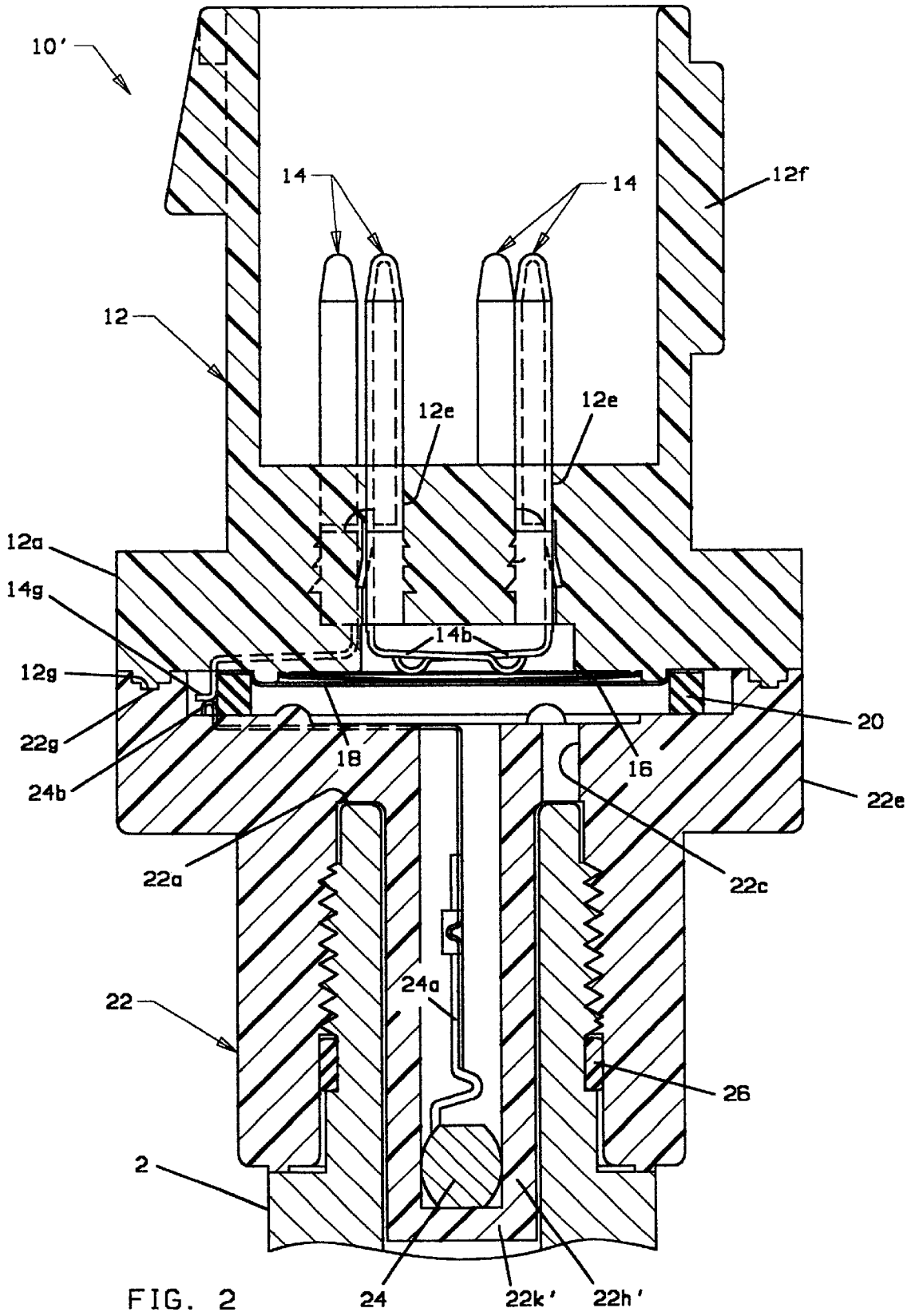
FIG. 2 is similar to FIG. 1 but shows a modified preferred embodiment of the invention.

FIG. 2 shows a modified embodiment in which temperature sensing portion 22*h*' is modified to have a closed distal end 22*k*'. Thermistor 24 is disposed in close thermal coupling with the closed end for optimum heat transfer with fluid in nipple 2. In other respects, the structure of device 10' is the same as in FIG. 1 and need not be further described.

Figure 3:
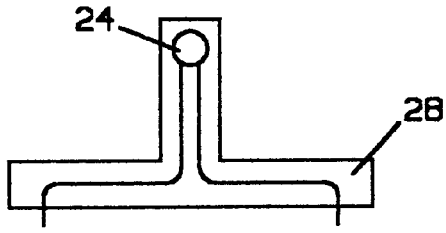
FIG. 3 is a schematic sketch of a modified temperature sensing portion of the combined switch and temperature sensing structure made in accordance with the invention.
Figure 4:
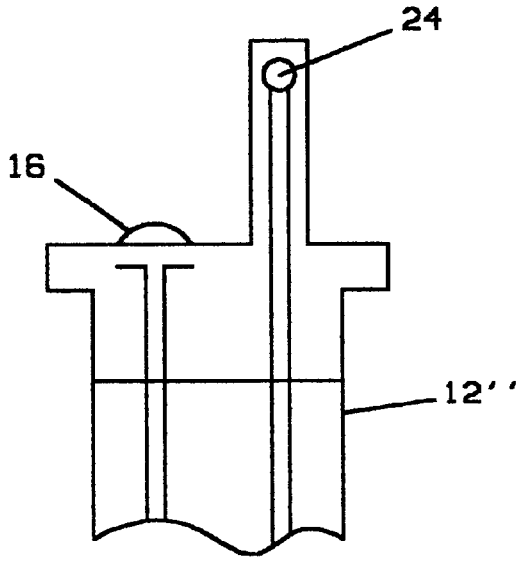
FIG. 4 is a schematic sketch of another modified temperature sensing portion of the combined switch and temperature sensing structure made in accordance with the invention.

If desired, thermistor 24 could be encapsulated in a plastic overmolded member 28, as shown in FIG. 3, which can be crimped or otherwise attached to the base member. Yet another variation is to mold thermistor 24 into a plastic finger projecting from a base member 12" as indicated in FIG. 4, or if desired, from the port fitting in a manner similar to FIG. 2.

It will appreciated that in addition to using the combined switch and temperature sensor for automotive evaporator temperature sensing for A/C systems described above, the combined device can be used for various other purposes, for example, in automotive variable cam timing to sense low oil pressure coupled with oil temperature or automotive engine coolant temperature/low pressure sensing.

Various modifications of the embodiments described are possible within the scope of the invention claimed. It is the intention that the appended claims be interpreted as broadly as possible in view of the prior art to include all such variations and modifications.

What is claimed is:

1. A combined pressure responsive electrical switch and temperature sensor device comprising an electrically insulative base member having an end wall with an end face surface, the end face surface formed with a generally circular disc seat on the end face surface, a plurality of bores formed through the end wall, an electrically conductive snap-acting disc disposed on the disc seat, the disc movable between first and second oppositely dished configurations, first and second electrically conductive contact arms flexibly mounted in the base member and having a portion extending transversely over and spaced from the end wall and aligned with the snap-acting disc, the snap-acting disc movable into and out of engagement with the contact arms to close and open a circuit path therebetween, a port fitting coupled to the base with a pressure chamber formed therebetween, a flexible member received over the disc to maintain the disc in the disc seat and provide a fluid seal between the disc and the pressure chamber, the port fitting having a tubular wall formed with a closed ended bore having a threaded side wall extending along a longitudinal axis, a passageway extending through the port fitting between the closed ended bore and the pressure chamber, an elongated temperature sensing portion of the port fitting extending into the threaded bore and being spaced from the side wall of the bore and a temperature responsive member disposed in the elongated temperature sensing portion, the elongated temperature sensing portion having a size selected to fit within a bore of a fluid pressure source nipple, the bore of the nipple being defined by a wall, the nipple being received in the closed ended bore with the temperature sensing portion sufficiently spaced from the wall defining the bore of the nipple to permit fluid flow from the nipple to the pressure chamber, and a plurality of terminals mounted in respective bores of the base member end wall connected to the contact arms and to the temperature responsive member.

2. A combined pressure responsive electrical switch and temperature sensor device comprising an electrical insulative base member having an end wall with an end face surface, the end face surface formed with a generally circular disc seat on the end face surface, a plurality of bores formed through the end wall, an electrical switch mounted on the base member, the electric switch including a pressure responsive snap-acting disc disposed on the disc seat and movable between opposite dished configurations to actuate and de-actuate the electrical switch, a port fitting coupled to the base with a pressure chamber formed therebetween, a flexible member received over the snap-acting disc to maintain the snap-acting disc on the disc seat and to provide a seal between the snap-acting disc and the pressure chamber, the port fitting having a tubular wall formed with a closed ended bore having a side wall extending along a longitudinal axis, a passageway extending through the port fitting between the closed ended bore and the pressure chamber, an elongated temperature sensing portion of the port fitting extending into the closed ended bore and being spaced from the side wall of the bore and a temperature responsive member disposed in the elongated temperature sensing portion, the elongated temperature sensing portion having a size selected to fit within a bore of a fluid pressure source nipple, the bore of the nipple being defined by a wall, the nipple being received in the closed ended bore with the temperature sensing portion sufficiently spaced from the wall defining the bore of the nipple to permit fluid flow from the nipple into the pressure chamber, and a plurality of terminals mounted in respective bores of the base member end wall connected to the electrical switch and to the temperature responsive member.

3. A combined pressure responsive electrical switch and temperature sensor device according to claim 2 in which the temperature responsive member is a thermistor.

4. A combined pressure responsive electrical switch and temperature sensor device according to claim 3 in which the elongated temperature sensing portion is generally hollow.

5. A combined pressure responsive electrical switch and temperature sensor device according to claim 3 in which the elongated temperature sensing portion is hollow tube having a distal closed end and the thermistor is disposed in close thermal coupling with the closed end.

6. A combined pressure responsive electrical switch and temperature sensor device according to claim 3 in which the elongated temperature sensing portion is a hollow tube having a distal open end and the thermistor is disposed adjacent the distal open end.

7. A combined pressure responsive electrical switch and temperature sensor device according to claim 3 in which the elongated temperature sensing portion is generally solid.

8. A combined pressure responsive electrical switch and temperature sensing device according to claim 3 in which a recess having a selected periphery is formed between the base member and the port fitting and an endless gasket is received between the base member and the port fitting inboard of at least a portion of the selected periphery to form an outer contact cavity with the pressure chamber being disposed inboard of the gasket and leads extend from the thermistor to a proximate end of the temperature sensing portion and radially outwardly through the port fitting beyond the gasket to a thermistor contact end in the contact cavity and selected terminals have a portion extending to a terminal contact end in the contact cavity and biased into engagement with a respective thermistor contact end.

* * * * *